US005083477A

United States Patent [19]

Geil

[11] Patent Number: 5,083,477

[45] Date of Patent: Jan. 28, 1992

[54] CONTROL KNOB LOCKING ASSEMBLY

[75] Inventor: Ron J. Geil, Vermilion, Ohio

[73] Assignee: Gould Inc., Eastlake, Ohio

[21] Appl. No.: 648,565

[22] Filed: Jan. 31, 1991

[51] Int. Cl.[5] ..... G05G 1/10

[52] U.S. Cl. ..... 74/553; 74/531; 74/554

[58] Field of Search ..... 74/502, 531, 553, 554

[56] References Cited

U.S. PATENT DOCUMENTS

| | | | |
|---|---|---|---|
| 2,312,590 | 3/1943 | Reynolds | 287/52.09 |
| 2,542,434 | 2/1951 | Russell | 112/236 |
| 2,546,157 | 3/1951 | Hume | 287/58 |
| 2,900,148 | 8/1959 | Nickels | 74/531 X |
| 3,292,956 | 12/1966 | Schiansky | 287/58 |
| 3,619,594 | 11/1971 | Morez | 74/553 X |
| 3,916,721 | 11/1975 | Egger | 74/553 |
| 3,924,957 | 12/1975 | Camosso | 403/352 |
| 4,154,125 | 5/1979 | Frank | 74/553 |
| 4,373,405 | 2/1983 | Geil | 74/553 X |
| 4,674,780 | 6/1987 | Weinerman et al. | 74/531 X |

*Primary Examiner*—Allan D. Herrmann
*Assistant Examiner*—David W. Laub
*Attorney, Agent, or Firm*—D. Peter Hochberg; Mark Kusner; Louis J. Weisz

[57] ABSTRACT

A control knob assembly to be mounted to a panel for use with an adjustable rotary device of the type having a push and/or pull function comprising a control knob having a first portion dimensioned to be grasped by a user, a second portion which is cylindrical in shape and extends from the first portion and a bore extending into the cylindrical portion aligned along the axis of the cylindrical portion, the bore dimensioned to receive a shaft of the rotary control member. A mounting element for mounting assembly to a panel is provided and includes a plurality of annularly arranged, flexible clamping elements, each having a threaded outer surface and a smooth inner surface. The inner surfaces of the clamping elements generally define a smooth cylindrical bore which is dimensioned to receive the cylindrical portion of the control knob and the outer surfaces of the clamping elements define a threaded surface. A locking ring is provided and dimensioned to be circumferentially mounted on the clamping elements. The locking ring includes an internal threaded surface dimensioned to matingly engage the outer threaded surfaces of the clamping elements wherein the locking ring is operable to releasably compress the clamping elements into engagement with the cylindrical portion of the control knob.

11 Claims, 3 Drawing Sheets

CONTROL KNOB LOCKING ASSEMBLY

FIELD OF THE INVENTION

The present invention relates to a control device, and more particularly to an adjustable knob and locking assembly.

BACKGROUND OF THE INVENTION

Numerous electrical instruments, such as oscilloscopes, recorders and the like, typically include control knobs to adjust operating parameters. In many instances, it is desirable for the efficient utilization space and economy of components to utilize control knobs which are capable of positional adjustment for controlling or varying an operating parameter and which can also be used to perform a switching operation, such as an "ON/OFF" switch. Such control knobs are typically angularly rotatable about a fixed axis and linearly movable along such axis, wherein the angular rotation is utilized to vary an operating parameter and the linear motion generally controls a switching feature. Examples of such control knobs would be an "ON/OFF volume" control knob typically found on a stereo receiver or an "ON/OFF-gain" control knob on a potentiometer or an "ON/OFF-trace position" control knob on a recording device. With many such electrical instruments, particularly electrical recording or monitoring instruments, it is desirable to lock the control knob in a specific position once a particular setting has been obtained.

With electronic components and equipment becoming smaller and more compact, there is a need for a lockable control knob which is small in size, yet provides positive locking and positioning of the control knob. It is likewise desirable to provide a control knob which is infinitely positionable and lockable in such positions. Locking control knobs known heretofore generally do not effectively or satisfactorily lend themselves to reduction in size in that many include components which are intricate and costly to manufacture in smaller sizes. Moreover, many control knobs known heretofore generally have limited angular adjustment and operate in stepped increments by detente arrangements or the like.

The present invention overcomes these shortcomings and provides a miniature locking control knob which may be set and locked in an infinite number of position settings and which is reliable, simple and relatively inexpensive.

SUMMARY OF THE INVENTION

In accordance with a preferred embodiment of the present invention, there is provided a control knob assembly to be mounted to a panel for use with an adjustable rotary control device of the type having a push and/or pull function. The assembly includes a control knob having a first portion dimensioned to be grasped by a user, a second portion which is cylindrical in shape and extends from the first portion and means adapted to secure the knob to a shaft of the rotary control member. A mounting element including means for mounting the element to said panel through an opening in the panel is provided and includes a plurality of annularly arranged, flexible clamping elements, each having a threaded outer surface and a smooth inner surface. The inner surfaces of the clamping elements define a smooth cylindrical bore which is dimensioned to receive the second portion of the control knob and the outer surfaces of the clamping elements define a threaded surface. An axial opening communicates with the bore and is dimensioned to receive the shaft of the rotary control member. A locking ring dimensioned to be circumferentially mounted on the clamping elements is provided and includes an internal tapered threaded surface dimensioned to matingly engage the outer threaded surfaces of the clamping elements wherein the locking ring is operable to releasably compress the clamping elements into engagement with the second portion of the control knob.

It is an object of the present invention to provide a miniature locking control knob assembly wherein the control knob has a rotational and linear range of motion.

It is another object of the present invention to provide an assembly as described above which prevents unintentional repositioning of the control knob during the locking action.

It is another object of the present invention to provide an assembly as described above wherein the control knob may be locked in an infinite number of rotary positions.

A still further object of the present invention is to provide an assembly as described above wherein the position of the control knob is not altered or affected when locking action takes place.

Another object of the present invention is to provide an assembly as described above which is reliable and simple to manufacture and use.

These and other objects and advantages will become apparent from a reading of the following description considered with the drawings, and appended claims.

BRIEF DESCRIPTION OF THE DRAWINGS

The invention may take form in certain parts and arrangement of parts, a preferred embodiment of which will be described in detail in the specification and illustrated in the accompanying drawings which form a part thereof and wherein.

DETAILED DESCRIPTION OF THE PREFERRED EMBODIMENT

Figure 1A:
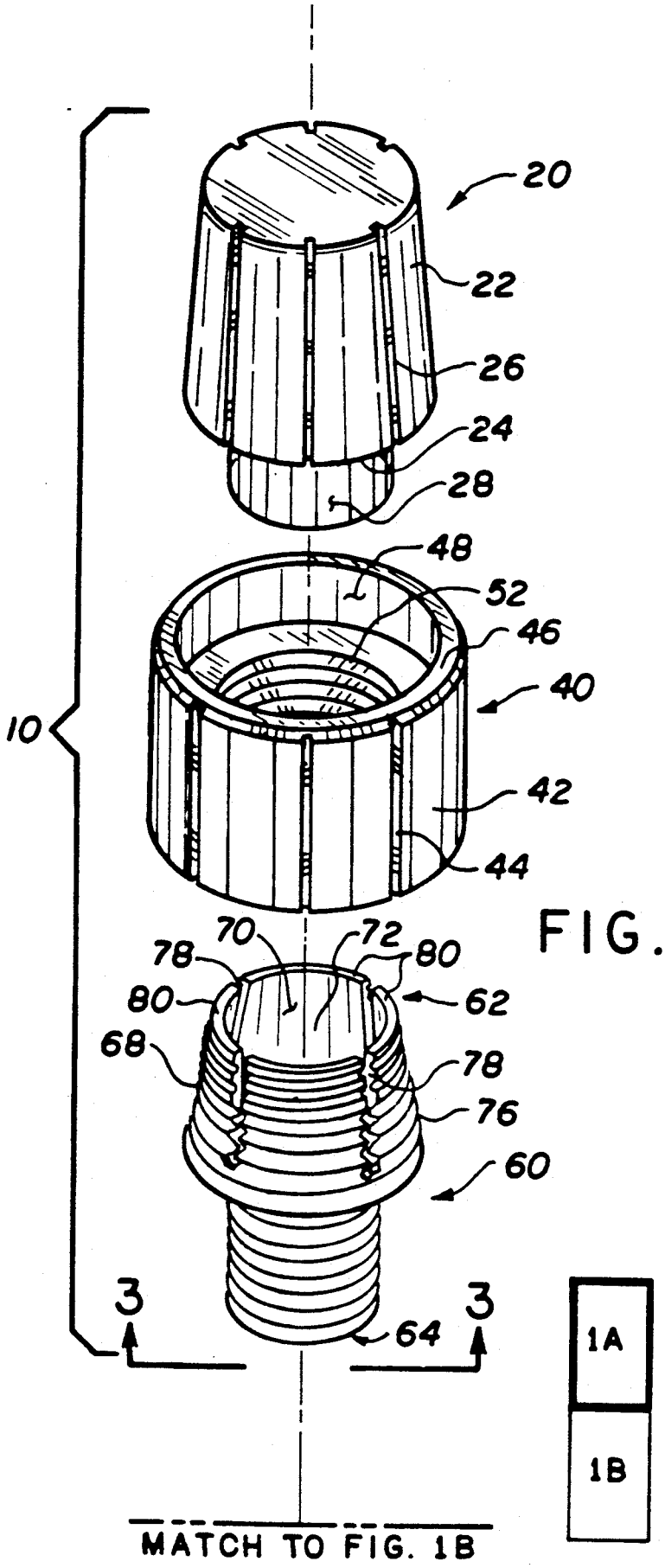
FIGS. 1A and 1B are exploded perspective views of a control knob locking assembly illustrating a preferred embodiment of the present invention.
Figure 1B:
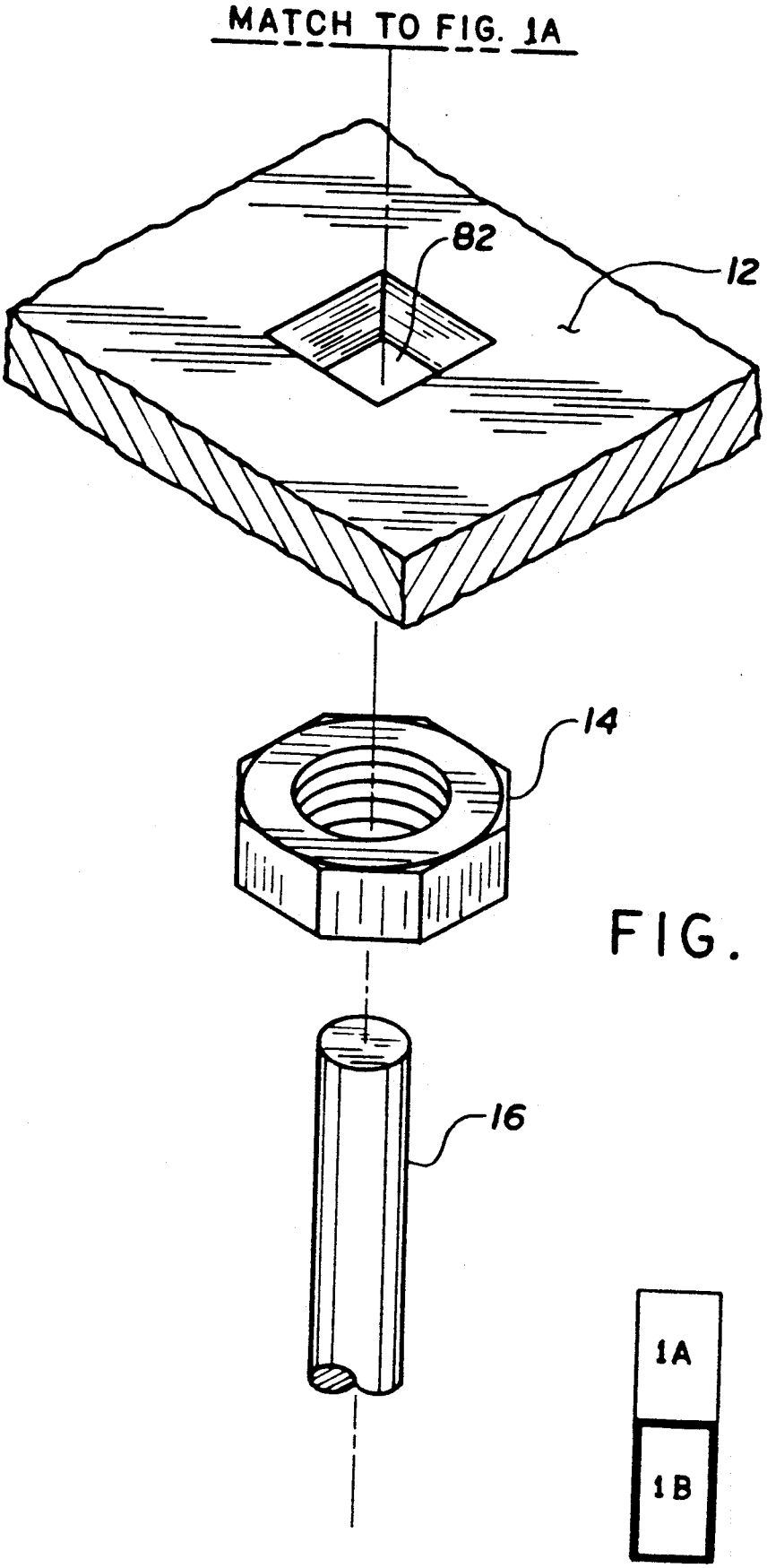

Referring now to the drawings wherein the showing is for the purpose of illustrating a preferred embodiment of the invention only, and not for the purpose of limiting same, the drawings show a control knob locking assembly 10 according to the present invention. Assembly 10 is generally comprised of a control knob 20, a locking ring 40, and a mounting bushing 60. In the embodiment shown, locking assembly 10 is dimensioned to be mounted by a conventional fastener 14 to a panel, designated 12 in the drawings. Assembly 10 is adapted to be operable in conjunction with an adjustable rotary control device (not shown) of a type having a push and/or pull function, wherein the rotary control device has a shaft, shown and designated 16 in the drawings.

In the embodiment shown, control knob 20 is generally cylindrical in shape and includes a first gripping portion 22 and a shank portion 24 extending therefrom.

Gripping portion 22 has the shape of a conical frustum, and the sides thereof include a plurality of grooves 26 which are provided to facilitate gripping of the control knob 20. Control knob 20 is generally symmetrically disposed about an axis which extends therethrough. Shank portion 24 is generally cylindrical in shape and is coaxially aligned gripping portion 22 and has a smooth outer annular surface 28. Locking assembly 10 is adapted to be fixedly attached to shaft 16 of a rotary control member. Typically, shaft 16 would be elongated and cylindrical in shape. In this respect, control knob 20 includes an axially aligned bore dimensioned to receive shaft 16. Control knob 20 is fixedly mounted to shaft 16 by conventional means (not shown) such as a set screw, pin, threaded fastener, or the like.

Figure 2:
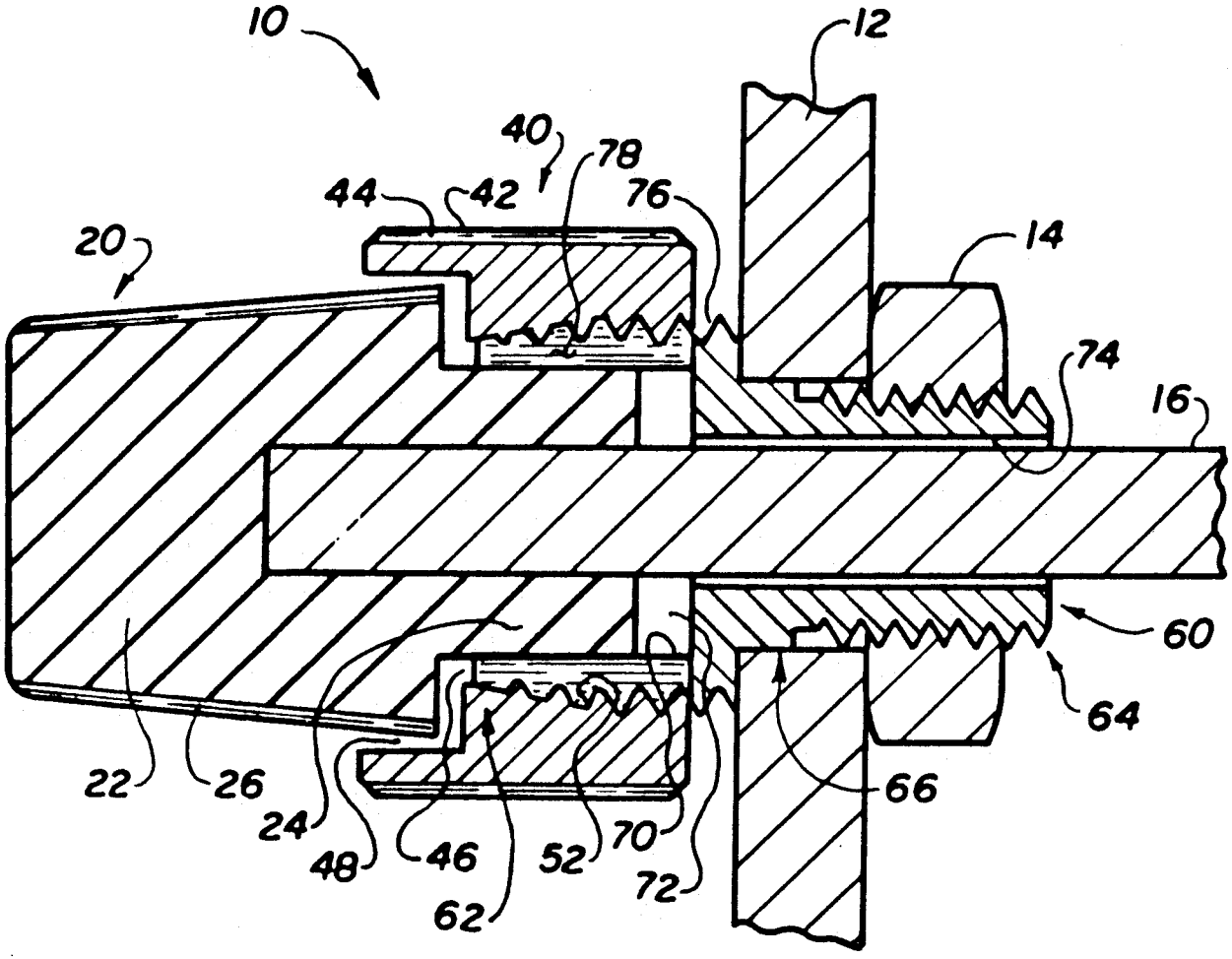
FIG. 2 is an enlarged sectional view of the assembly shown in FIG. 1.

Locking ring 40 is generally cylindrical in shape and includes an outer surface 42 having a plurality of grooves 44 formed therein to facilitate gripping of the ring by a user. An axially aligned opening 46 extends through locking ring 40. Opening 46 includes a counterbored portion 48 and a threaded portion 52. Counterbored portion 48 is dimensioned to receive gripping portion 22 of control knob 20. According to the present invention, threaded portion 52 includes straight, internal threads having a tapered lead portion wherein the root diameter of the thread decreases along a predetermined angle as best seen in FIG. 2. In the embodiment shown, the taper is approximately 20° included angle.

Mounting bushing 60 is generally tubular in shape and includes a first end 62, a second end 64, and an intermediate portion 66. End 62 is generally comprised of an annular wall 68 having a smooth inner surface 70 which defines a cylindrical bore 72. Bore 72 is dimensioned to slidably receive shank portion 24 of control knob 20. Bore 72 communicates with a smaller open 74 which is dimensioned to receive shaft 16 therethrough and to have a clearance therearound. Annular wall 68 has an outer surface 76 having external threads dimensioned to match and engage the internal threads on locking ring 40. In this respect, the threads near the free end of wall 68 are chamfered. The chamfered portion, best seen in FIG. 2, starts at the root diameter of the thread and has a chamfer angle of approximately 10° (20° included angle). As best seen in FIG. 1A, wall 68 of mounting bushing 60 includes a plurality of equally spaced, slots 78 extending therethrough, which define a plurality of flexible clamping elements 80.

Figure 3:
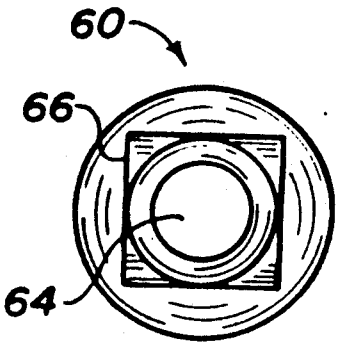
FIG. 3 is a view taken along line 3—3 of FIG. 1A.

Referring now to FIGS. 2 and 3, intermediate portion 66 which is disposed between first end 62 and second end 64 bushing 60, is shown. As seen in the drawings, intermediate portion 66 is rectangular in shape and is dimensioned to be received and match a corresponding rectangular opening 82 in panel 12. Intermediate portion 66 and opening 82 are non-circular to prevent rotational movement of mounting bushing 60 relative to panel 12. Second end 64 of bushing 60 is generally cylindrical in shape and has an outer threaded surface 52 which is dimensioned to be matingly received by standard threaded fastener 14. Fastener 14 is operable to secure bushing 60 to panels 12 as shown in FIG. 2.

Control knob 20, locking ring 40 and bushing 60 as heretofore described are preferably formed of a plastic material. Importantly, locking ring 40 is formed of a material having a high lubricity, such as molybdenum disulfide nylon thermoplastic to reduce friction between it and mounting bushing 60. Mounting bushing 60 is perferably formed of an engineering plastic having hard, rigid, tough and resilient characteristics, such as ABS resin, acrylic resin, acetal resin, fluorocarbon polymers, nylon, phenol-formaldehyde resin, polybutylene terephthalate, polycarbonate, polyethelene, polyphenylene oxide, polypropylene, polystyrene, polyvinyl chloride, reinforced plastic (FRP) and urea-formaldehyde resin. In the embodiment shown, mounting bushing is formed of acetal resin manufactured by DuPont de Nemours, E. I. & Company under the trademark DELRIN TM.

The above-identified structure is not limited in size, it finds particularly advantageous application for miniature control knob assemblies. In this respect, the embodiment shown includes a locking ring 40 preferably having an outer diameter of less than $\frac{5}{8}$ of an inch.

Referring now to the operation of the present invention, rotation of locking ring 40 in a clockwise direction on mounting bushing 60, causing the internal threads of locking ring 40 to engage the external threads on end 62 of mounting bushing 60. The tapered thread on locking ring 40 eventually engages the tapered thread on mounting bushing 60, which causes annular wall 68, specifically clamping elements to move radially inwardly as a result of the truncated thread of bushing 60 engaging the flatten root of locking ring 40. In this respect, clamping elements 80 which are formed by slots 78 in annular wall 68 are generally resilient. Locking ring 40 thus forces clamping elements 80 onto shank portion 26 of control knob 20 thereby preventing movement in either a radial or axial direction. Because mounting bushing 60 is formed of a generally flexible plastic material, control knob 20 may be locked in position with relatively minor force being exerted on locking ring 40. Importantly, because locking ring 40 is formed of a material having high lubricity, the engagement between the threads on locking ring 40 and mounting bushing 60 does not produce an immediate locking interaction between the two components, but rather, enables the thread of locking ring 40 to continually slide along the threads of end 62 of mounting bushing 60 and thereby force clamping elements 80 into engagement with shank portion 24 of control knob 20. In this respect, it has been found that without the lubricity between locking ring 40 and mounting bushing 60, locking ring 40 binds on end 62 of mounting bushing 60 without providing sufficient clamping force to ensure that control knob 20 cannot be moved.

Moreover, because shank portion 24 of control knob 20 and inner surface 70 of mounting bushing 60 are smooth surfaces, control knob 20 may be set in an infinite number of positions, both rotationally and axially and locked therein. Thus, there is provided a control knob having an infinite number of rotational and axial positions. More importantly, because the locking action produces a pure radial force on shank portion 24 of control knob 20, no displacement of control knob 20 occurs during the locking or unlocking actions of locking ring 40. Thus, control knob 20 can be easily locked in position by merely rotating locking ring 40 in a clockwise direction, and unlocking is easily accomplished by rotating the locking ring 40 in an opposite direction.

The present invention thus provides a control knob locking assembly particularly suitable in forming miniature control knobs. A control knob according to the present invention has an infinite number of rotary positions, an infinite number of axial positions within a predetermined range, and it may be locked in any positions quickly and easily.

While the present invention has been described with reference to a preferred embodiment, other modifications and alterations will occur to those skilled in the art upon a reading and understanding of the specification. It is intended that all such modifications and alterations be included insofar as they come within the scope of the appended claims or equivalence thereof.

Having described the invention, the following is claimed:

1. A control knob assembly to be mounted to a panel for use with an adjustable rotary control device of the type having a push and/or pull function comprising:

a control knob having a first portion dimensioned to be grasped by a user, a second portion which is cylindrical in shape and extends from said first portion and a bore extending into said cylindrical second portion aligned along the axis of said cylindrical second portion, said bore dimensioned to receive a shaft of said rotary control member;

a mounting element adapted to be mounted to said panel through a non-cylindrical opening in said panel, said mounting element having:

a first end including a plurality of annularly arranged, flexible clamping elements, each having a threaded outer surface and a smooth inner surface, the inner surfaces of said clamping elements generally defining a smooth cylindrical bore which is dimensioned to receive said cylindrical second portion of said control knob and the outer surfaces of said clamping elements defining a thread surface having an increasing taper of approximately 10°, a second end of smaller diameter than said first end, having a threaded portion which is dimensioned to receive a conventional fastener, a non-cylindrical intermediate portion between said first end and said second end, said intermediate portion dimensioned to be matingly received within said non-cylindrical opening in said panel, and an axial opening communicating with said bore dimensioned to receive said shaft of said rotary control member; and a locking ring dimensioned to be circumferentially mounted on said clamping elements, said locking ring including an internal threaded surface having a decreasing taper of approximately 10° dimensioned to matingly engage said outer threaded surfaces of said clamping elements wherein said locking ring is operable to releasably compress said clamping elements into engagement with said cylindrical second portion of said control knob.

2. An assembly as defined in claim 1 wherein said first end of said mounting element is generally tubular and has a plurality of equi-spaced radial slots formed therein.

3. An assembly as defined in claim 2 wherein said intermediate portion is generally rectangular.

4. An assembly as defined in claim 1 wherein said mounting element and said locking ring are formed of a plastic material.

5. An assembly as defined in claim 4 wherein said locking ring is formed from molybdenum disulfide filled nylon.

6. An assembly as defined in claim 1 wherein said locking ring has an outer diameter of less than ¾".

7. An assembly as defined in claim 4 wherein said mounting element is formed from Delrin TM thermoplastic.

8. A control knob assembly for mounting to a panel for use with an adjustable rotary control device of the type having a push and/or pull function comprising:

a control knob having a first portion dimensioned to be grasped by a user, a second portion which is cylindrical in shape and extends from said first portion and a bore extending into said cylindrical second portion aligned along the axis of said cylindrical second portion, said bore dimensioned to receive shaft of said rotary control member;

a mounting element having a first end including a threaded portion which is dimensioned to receive a conventional fastener, a non-cylindrical intermediate portion dimensioned to be matingly received within an opening in said panel, a second end including an enlarged cylindrical portion having external tapered threads having thread crests of increasing diameter, a mounting surface defined between said intermediate portion and threaded portion of said second end, and an axially aligned opening dimensioned to receive said control rod therethrough, said opening including a cylindrical portion dimensioned to slidably receive said cylindrical second portion of said control knob; and locking ring having internal tapered threads having thread roots of decreasing diameter dimensioned to operatively engage said external threads on said mounting element to compress and release said cylindrical second portion.

9. A control knob assembly to be mounted to a panel for use with an adjustable rotary control device of the type having a push and/or pull function comprising:

a control knob having a first portion dimensioned to be grasped by a user, a second portion which is cylindrical in shape and extends from said first portion and a means associated with said second portion for attachment to a shaft of said rotary control member;

a mounting element including means for mounting said element to said panel through an opening in said panel, a plurality of annularly arranged, flexible clamping elements, each having a threaded outer surface and a smooth inner surface, the inner surface of said clamping elements generally defining a smooth cylindrical bore which is dimensioned to receive said second portion of said control knob and the outer surfaces of said clamping elements defining a taper threaded surface having thread crests of increasing diameter, an axial opening communicating with said bore dimensioned to receive said shaft of said rotary control member; and a locking ring dimensioned to be circumferentially mounted on said clamping elements, said locking ring including an internal tapered threaded surface having thread roots of decreasing diameter dimensioned to matingly engage said outer threaded surfaces of said clamping elements wherein said locking ring is operable to releasably compress said clamping elements into engagement with said second portion of said control knob.

10. An assembly as defined in claim 9 wherein said mounting element and said locking ring are formed of a plastic material.

11. An assembly as defined in claim 10 wherein said locking ring is formed from molybdenum disulfide filled nylon.

* * * * *